United States Patent [19]

Juergens et al.

[11] Patent Number: 4,955,438

[45] Date of Patent: Sep. 11, 1990

[54] CORE DRILLING TOOL

[75] Inventors: Rainer Juergens, Celle; Axel Sperber, Edemissen, both of Fed. Rep. of Germany

[73] Assignee: Eastman Christensen Company, Salt Lake City, Utah

[21] Appl. No.: 341,928

[22] Filed: Apr. 21, 1989

[30] Foreign Application Priority Data

Apr. 22, 1988 [DE] Fed. Rep. of Germany ..... 3813508

[51] Int. Cl.[5] ..... E21B 25/02; E21B 47/022; E21B 47/06; E21B 47/12

[52] U.S. Cl. ..... 175/40; 166/64; 166/65.1; 175/44; 175/45; 175/50; 175/246

[58] Field of Search ..... 175/40, 44, 45, 48, 175/50, 20, 246, 247, 248, 249, 236, 239; 166/64, 65.1

[56] References Cited

U.S. PATENT DOCUMENTS

| | | | |
|---|---|---|---|
| 2,820,610 | 1/1958 | Martinez | 175/249 X |
| 3,059,707 | 10/1962 | Frisby | 175/45 X |
| 3,346,059 | 10/1967 | Svendsen | 175/246 |
| 4,515,225 | 5/1985 | Dailey | 175/40 |
| 4,562,560 | 12/1985 | Kamp | 175/40 X |
| 4,715,022 | 12/1987 | Yeo | 175/48 |
| 4,765,414 | 8/1988 | Moore | 175/246 X |

*Primary Examiner*—Stephen J. Novosad
*Attorney, Agent, or Firm*—Arnold, White & Durkee

[57] ABSTRACT

A core drilling tool for drilling rock in underground soil formations which includes an outside pipe and an inside pipe therein that can be conveyed separately to the surface. The inside pipe includes a core-receiving receptacle at its lower end, and at its upper end is provided with a measurement unit for on-site acquisition, processing and storage of data, such as borehole, core and/or drilling process parameters.

11 Claims, 2 Drawing Sheets

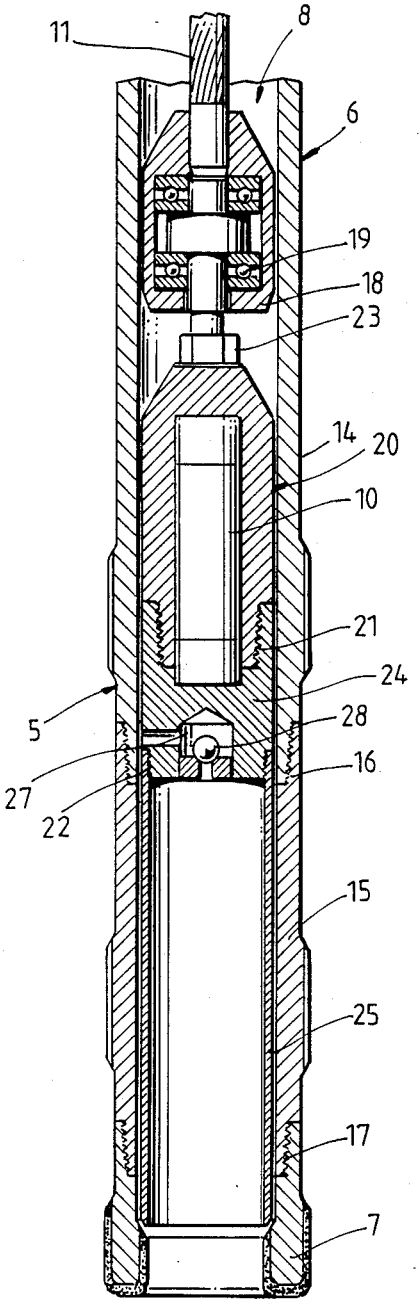
Fig. 2
Fig. 3
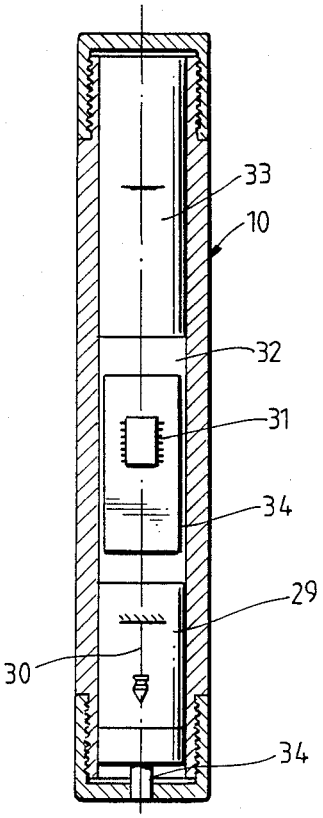

CORE DRILLING TOOL

BACKGROUND OF THE INVENTION

This invention concerns, generally, improvements to a core drilling tool such as that shown, for example, in U.S. Pat. No. 1,134,203, and more specifically relates to methods and apparatus for measuring parameters concerning the borehole, drilling core, or drilling process.

This invention is based on the problem of creating a core drilling tool of this type so that in addition to obtaining rock samples, data can also be obtained from the borehole to increase the efficiency of the core drilling operation.

SUMMARY OF THE INVENTION

The arrangement of the measurement unit in the upper area of the core pipe part of the inside pipe, which cannot twist relative to the outside pipe, permits not only continuous data acquisition, processing and storage virtually independent of interfering influences in the drilling operation but also permits data transmission to an above-ground information receiver in a manner that is independent of the design of the outside pipe and the pipe string, so data transmission is either intermittent or if necessary it may be continuous. An especially simple intermittent transmission of data after compilation, processing and storage takes place in combination with the extraction of the core pipe for conveying a core sample to the surface. Another possibility of above-ground transmission of data in a manner that is independent of the conveyance of the inside pipe to the surface is achieved by means of a measurement unit that can be conveyed above ground by means of a special gripping tool that is detachable from the core pipe part and is independent of the latter. This presupposes only a ring-shaped basic design of the carrying part of the inside pipe. For the purpose of intermittent or continuous data transmission to an above-ground information receiver, the measurement unit can be linked up to a pressure pulse generator with the help of which pressure pulses corresponding to the data determined by the measurement unit and detectable by sensors above ground can be produced in the drilling mud.

Measurement units for detection of selected data in a borehole are fundamentally known but they consist either of units that can be lowered separately into a borehole by means of a cable, etc., or units that are attached to the drilling tool and can be conveyed back to the surface only with it in a round trip (U.S. Pat. Nos. 4,161,782; 4,389,792 and 4,499,955).

BRIEF DESCRIPTION OF THE DRAWINGS

FIG. 2 shows, a cutaway longitudinal section through a core drilling tool of a design according to this invention.

FIG. 3 shows a schematic individual diagram of the measurement unit, partially in longitudinal section.

DETAILED DESCRIPTION OF THE PREFERRED EMBODIMENTS

Figure 1:
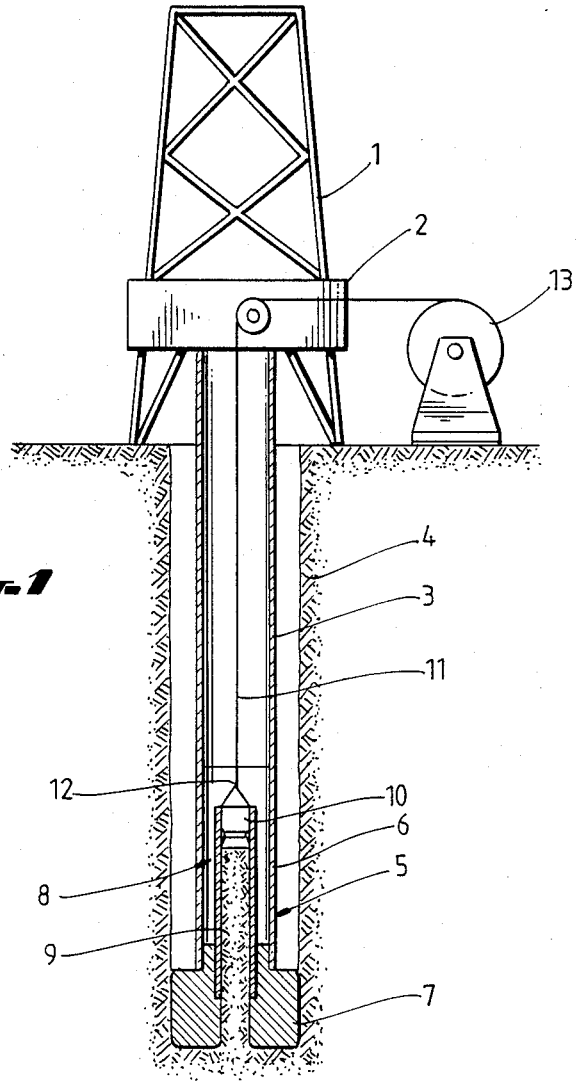
FIG. 1 shows a cutaway schematic overall diagram of a core drilling installation with a core drilling tool according to this invention, partially in sectional view.

FIG. 1 illustrates in schematic diagram a drilling installation with a drilling rig 1 and a drilling platform 2 with a revolving stage (not shown in detail) that can be set in rotation by means of a drive and is provided for a drill column 3 which extends down to a core drilling tool 5 in a borehole 4.

Core drilling tool 5 includes an outside pipe 6 which is connected at its upper end by means of connecting devices (not shown in detail), e.g., screw thread connections, to the lower end of drill column 3 and at its other end is connected to a core drilling crown 7.

Furthermore, the core drilling tool includes an inside pipe 8 which forms a structural unit that can be conveyed separately to the surface and is designed at the lower end as a receptacle for a core 9 that is to be bored continuously, and in its upper area it is provided with a measurement unit 10 for on site acquisition, processing and storage of data in the form of borehole parameters, core parameters and/or drilling process parameters. Inside pipe 8 and the measurement unit 10 provided with it can be hydraulically conveyed to the surface together by means of the drilling mud, but the inside pipe 8 can also be pulled by a towing device 11 which can be connected by means of a gripping device 12 to the upper end of inside pipe 8 and above ground runs onto a winding drum 13 that can be rotated by means of a drive (not shown).

As indicated in FIG. 2, the outside pipe 6 of core drilling tool 5 consists of several pipe sections 14 and 15 which are screwed together at 16 and are connected to core drilling crown 7 by means of a screw connection 17.

Inside pipe 8 includes a carrying part 18 which is supported in pipe 6 and is corotational with it and a core pipe part 20 which is suspended on the carrying part by means of a bearing 19 relative to the outside pipe 6 so it cannot twist. In the example shown here, core pipe part 20 consists of parts 23, 24 and 25, which are screwed together at 21 and 22.

The two parts 23 and 24 of core pipe part 20 together enclose the measurement unit 10 which is located accordingly in the upper area of core pipe part 20 while the lower part 25 forms the receptacle for a core 9 cut by the drilling operation. The inside of the lower part 25 of core pipe part 20 is connected by a passage 27 to the annular space, but this connection is interrupted by a ball valve 28 in core drilling operation.

As indicated in FIG. 3, which shows measurement unit 10 in diagram form, measurement unit 10 may include, for example, a measured value pickup unit 29 with a number of measured value pickups 30, only one of which is illustrated here, a processing unit 31 for data and a storage unit 32 for storage of data. Finally, measurement unit 10 includes a power supply unit 33 to supply it with power. In the example illustrated here, the power supply unit consists of a set of rechargeable electric batteries. Instead of this, power supply unit 33 may also consist of an electric generator that can be driven with drilling mud. When rechargeable batteries are used, as is preferred in most cases for reasons of cost, it is self-evident that the batteries should especially take into account the conditions in underground operation, especially the temperature conditions.

The measurement unit may have an area that is shielded by a heat protection device 34 and is provided to accommodate heat-sensitive components such as microprocessors, etc., but instead of this it is also possible to equip each of the respective heat-sensitive components with a separate heat protection device.

Measured value pickup 30 is preferred for acquisition of data such as the borehole temperature, the borehole slope, the borehole azimuth, drilling progress, drilling pressure, torque, rotational speed, nature of the rock, core gain, core advance, core jamming, core orientation and/or core properties, and the data picked up by measure value pickups 30 are processed according to given programs in processing unit 31 and are stored in processed and/or unprocessed for in memory unit 32.

In order to send the data that have been picked up, processed and stored to an information receiver above ground, measurement unit 10 can be removed from the upper area of core pipe part 20 after inside pipe 8 has been pulled up and the data can be taken from measurement unit 10 by way of its communications connection 34 which can also be associated with resetting measurement unit 10 for a new operating cycle.

Instead of this, it is also possible to grip measurement unit 10 by means of a separate gripping tool (not shown) if the upper end is arranged so it is exposed accordingly, and thereby detach it from the core pipe part 20 below ground and convey it to the surface separately in order to permit intermittent data transmission independently of the process of retracting the inside pipe 8.

Instead of this, it is also possible to have a constant data transmission, namely when measurement unit 10 is linked up with a pressure pulse generator (not shown) to generate pressure pulses in the drilling mud to correspond to the processed measured data so these pressure pulses can be picked up by means of sensors above ground.

A continuous data transmission is also conceivable by way of a line which can be located in the traction mechanism 11 when using such a mechanism that can be connected to inside pipe 8 by means of the gripping device 12. In this case, the gripping device 12 and measurement unit 10 can have connecting devices that enter into a data transmission mode of engagement when inside pipe 8 is gripped, e.g., connecting devices that permit inductive transmission.

In special cases, gripping device 12 with its traction device 11 may be in constant engagement with inside pipe 8 during the core drilling operations in order to assure continuous data transmission. As a rule, however, intermittent data transmission to the aboveground information receiver in the wake of retraction of inside pipe 8 is sufficient.

What is claimed is:

1. Core drilling tool for drilling rock in underground soil formations with an outside pipe that can be connected by means of connecting devices at its upper end to the lower end of a drill column that can be rotated by means of a drive and can be connected at its lower end to a core drilling crown, and with an inside pipe that forms a separate component that can be conveyed to the surface and a supporting part which is supported in the outside pipe and is co-rotational with the latter as well as a core pipe part suspended on the carrying part by means of a bearing so it will not twist relative to the outside pipe and can receive a core cut by the drilling process, wherein the core pipe part comprises a measurement unit located in its upper area for onsite acquisition, processing and storage of data that form parameters for the borehole, the drilling core and/or drilling process, and a traction device which can be connected to the inside pipe by means of a gripping device, said traction device comprising a line for transmission of measurement data to the surface.

2. Tool according to claim 1, wherein said measurement unit has a measured value pickup for acquisition of such data as the borehole temperature, slope, azumuth and/or drilling progress.

3. Tool according to claim 1, wherein said measurement unit includes measured value pickup for acquisition of data on drilling pressure, torque and/or rotational speed of the outside housing.

4. Tool according to claim 1, characterized in that measurement unit includes measured value pickup for acquisition of information regarding the properties of the rocks of the soil formation.

5. Tool according to claim 1, wherein said measurement unit includes measured value pickup for acquisition of data on core gain, progress, jamming, orientation and/or properties.

6. Tool according to claim 1, wherein said measurement unit can be retracted mechanically together with the inside pipe or can be conveyed to the surface hydraulically by means of drilling mud.

7. Tool according to claim 1, characterized in that measurement unit comprises rechargeable electric batteries for it power supply.

8. Tool according to claim 1, wherein said measurement unit is provided with an electric generator that can be driven with drilling mud for its power supply.

9. Tool according to claim 1, wherein said measurement unit can gripped underground by means of a separate gripping tool, can be detached from core pipe part and conveyed to the surface separately.

10. Core drilling tool for drilling rock in underground soil formations with an outside pipe that can be connected by means of connecting devices at its upper end to the lower end of a drill column that can be rotated by means of a drive and can be connected at its lower end to a core drilling crown, and with an inside pipe that forms a separate component that can be conveyed to the surface and a supporting part which is supported in the outside pipe and is co-rotational with the latter as well as a core pipe part suspended on the carrying part by means of a bearing so it will not twist relative to the outside pipe and can receive a core cut by the drilling process, wherein the core pipe part comprises a measurement unit located in its upper area for on-site acquisition, processing and storage of data that form parameters for the borehole, the drilling core and/or drilling process, wherein said measurement unit has at least one area shielded by a heat protection device to hold heat-sensitive components.

11. Core drilling tool for drilling rock in underground soil formations with an outside pipe that can be connected by means of connecting devices at its upper end to the lower end of a drill column that can be rotated by means of a drive and can be connected at its lower end to a core drilling crown, and with an inside pipe that forms a separate component that can be conveyed to the surface and a supporting part which is supported in the outside pipe and is co-rotational with the latter as well as a core pipe part suspended on the carrying part by means of a bearing so it will not twist relative to the outside pipe and can receive a core cut by the drilling process, wherein the core pipe part comprises a measurement unit located in its upper area for on-site acquisition, processing and storage of data that form parameters for the borehole, the drilling core and/or drilling process, wherein said heat-sensitive components of said measurement unit are provided with their own heat protection devices.

* * * * *